US008245533B2

(12) United States Patent
Avneri-Katzir et al.

(10) Patent No.: US 8,245,533 B2
(45) **Date of Patent: *Aug. 21, 2012**

(54) RING AND METHOD FOR WEARING

(76) Inventors: Shelly Avneri-Katzir, Charlotte, NC (US); Yifat Ungierowicz-Bloch, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/065,810

(22) Filed: Mar. 30, 2011

(65) Prior Publication Data

US 2011/0179824 A1 Jul. 28, 2011

Related U.S. Application Data

(60) Division of application No. 12/001,537, filed on Dec. 11, 2007, now abandoned, which is a continuation-in-part of application No. 29/264,506, filed on Aug. 14, 2006, now Pat. No. Des. 626,446.

(51) Int. Cl.
*A44C 5/00* (2006.01)

(52) U.S. Cl. ..... 63/15; 63/3.1; 63/3; 63/33; 29/896.412

(58) Field of Classification Search ..... 63/3, 15, 63/15.1–15.9, 33; 29/896.412; D11/26
See application file for complete search history.

(56) References Cited

U.S. PATENT DOCUMENTS

| | | | | |
|---|---|---|---|---|
| 4,913,365 | A * | 4/1990 | Shamass | 242/591 |
| 4,977,757 | A * | 12/1990 | Mesica et al. | 63/15 |
| 5,943,882 | A * | 8/1999 | Erb | 63/15.5 |
| 7,178,365 | B2 * | 2/2007 | Pitaniello | 63/15 |
| D626,446 | S * | 11/2010 | Katzir et al. | D11/26 |
| 2005/0274143 | A1 * | 12/2005 | Roberts/Shea | 63/15 |

* cited by examiner

*Primary Examiner* — Jack W. Lavinder
*Assistant Examiner* — Emily Morgan
(74) *Attorney, Agent, or Firm* — Ted Masters

(57) ABSTRACT

A jewelry ring and associated method includes a shank, and a cross member having ornamental elements which is received by the shank. The shank has two upwardly directed slots which accept the cross member and allow it to slide upward toward the ends of the shank. When the ring is worn the finger holds the cross member in the slots of the shank. The cross member includes ornamental elements which rotate around a rod. End members on the rod retain the ornamental elements, and prevent the rod from sliding transversely through the slots in the shank.

4 Claims, 4 Drawing Sheets

Fig. 3
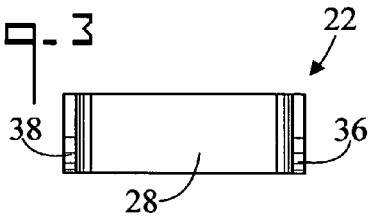
Fig. 4
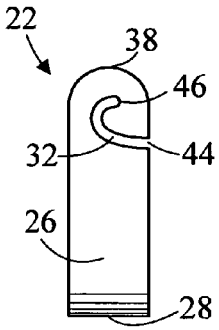
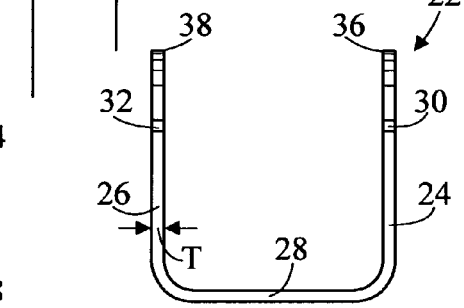
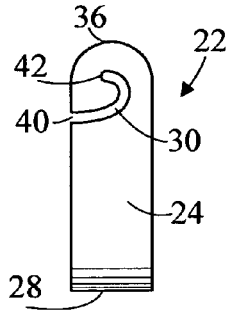
Fig. 6
Fig. 7
Fig. 5
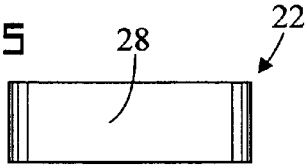
Fig. 8
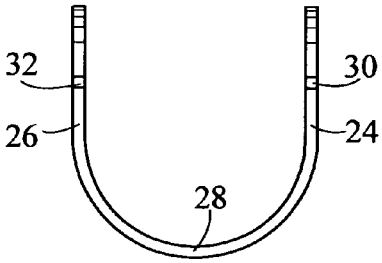
Fig. 9
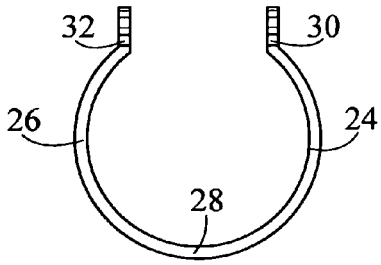

RING AND METHOD FOR WEARING

CROSS REFERENCE TO RELATED APPLICATION

This application is a Division of and claims the filing benefit under 35 U.S.C. §120 and §121 of application Ser. No. 12/001,537, filed Dec. 11, 2007, now abandoned which in turn is a Continuation in Part of and claims the filing benefit under 35 U.S.C. §120 of Application 29/264,506 (now Pat. No. D626,446), filed Aug. 14, 2006, both of which previously filed and claimed applications are hereby incorporated by reference.

TECHNICAL FIELD

The present invention pertains generally to rings, and more particularly to a ring which includes two components which are held together by the finger of the wearer.

BACKGROUND OF THE INVENTION

Rings which are worn on a finger typically comprise a generally round band which encircles the finger. The ring is worn by inserting the finger into the band and sliding the band past the knuckle of the finger.

BRIEF SUMMARY OF THE INVENTION

The present invention is directed to a jewelry ring and method of wearing the ring. The ring includes a generally U-shaped shank which has an open top portion. The top portion removably receives an ornamented cross member. Different interchangeable cross members having different ornaments may be utilized, thereby allowing the wearer to change the look of the ring to fit a desired style.

The ring includes a shank having two sides connected by a base. Each of the sides has a slot. A cross member which carries the ornament(s) is removably insertable into the slots and is slidably movable within the slots away from the base. When the finger is inserted into the ring, the finger urges the cross member away from the base and retains the cross member in the first and second slots.

In accordance with an embodiment of the invention, a ring for a finger includes a shank having a first side, an opposite second side, and a base connecting the first side and the second side. The first side has a first slot, and the second side has a second slot. A cross member is removably insertable into the first and second slots and slidably movable within the slots away from the base.

In accordance with another embodiment, the first side has a first end, and the second side has an opposite second end. The first slot has a first mouth and a first terminus, and the second slot has a second mouth and a second terminus. The first terminus is disposed between the first mouth and the first end, and the second terminus is disposed between the second mouth and the second end.

In accordance with another embodiment, the first and second slots are curved.

In accordance with another embodiment, the cross member has a first end and an opposite second end. The first end is insertable into the first slot, and the second end is insertable into the second slot.

In accordance with another embodiment, the cross member includes a rod.

In accordance with another embodiment, the rod has two opposite end members. When the cross member is inserted into the first and second slots, the end members reside outside of the first and second sides.

In accordance with another embodiment, at least one ornament is connected to the rod.

In accordance with another embodiment, the ornament is rotatable around the rod.

In accordance with another embodiment, a method for wearing a ring on a finger includes:

(a) providing ring components including:

a shank having a first side, an opposite second side, and a base connecting the first side and the second side, the first side having a first slot and the second side having a second slot; and, a cross member removably insertable into the first and second slots and slidably movable within the slots away from the base;

said shank and said cross member being unconnected;

said first slot having an open end which comprises a first mouth through which said cross member is removably insertable, and an opposite closed end which comprises a first terminus;

said second slot having an open end which comprises a second mouth through which said cross member is removably insertable, and an opposite closed end which comprises a second terminus;

(b) inserting said cross member into the first and second slots;

(c) slidably moving the cross member away from the base; and, (d) inserting the finger between the first and second sides and between the base and the cross member, wherein the finger retains the cross member in the first and second slots.

Other possible embodiments, in addition to the possible embodiments enumerated above, will become apparent from the following detailed description, taken in conjunction with the accompanying drawings, which illustrate, by way of example, the principles of the ring and method of wearing.

BRIEF DESCRIPTION OF THE DRAWINGS

FIG. 3 is a top plan view of a shank;

FIG. 4 is a front elevation view of the shank;

FIG. 5 is a bottom plan view the shank;

FIG. 6 is a side elevation view of the shank;

FIG. 7 is an opposite side elevation view of the shank;

FIG. 8 is a front elevation view of another embodiment of the shank;

FIG. 9 is a front elevation view of another embodiment of the shank;

DETAILED DESCRIPTION OF THE INVENTION

Figure 1:
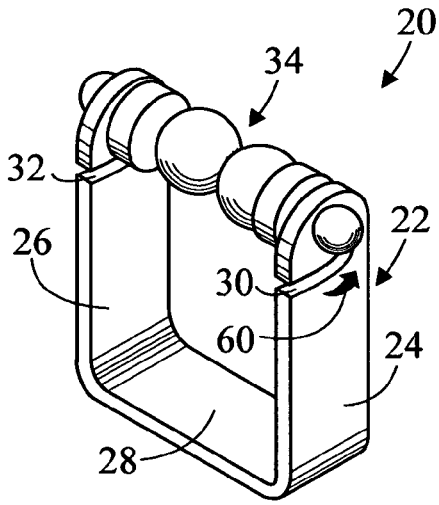
FIG. 1 is a perspective view of a ring for a finger in accordance with the present invention.
Figure 2:
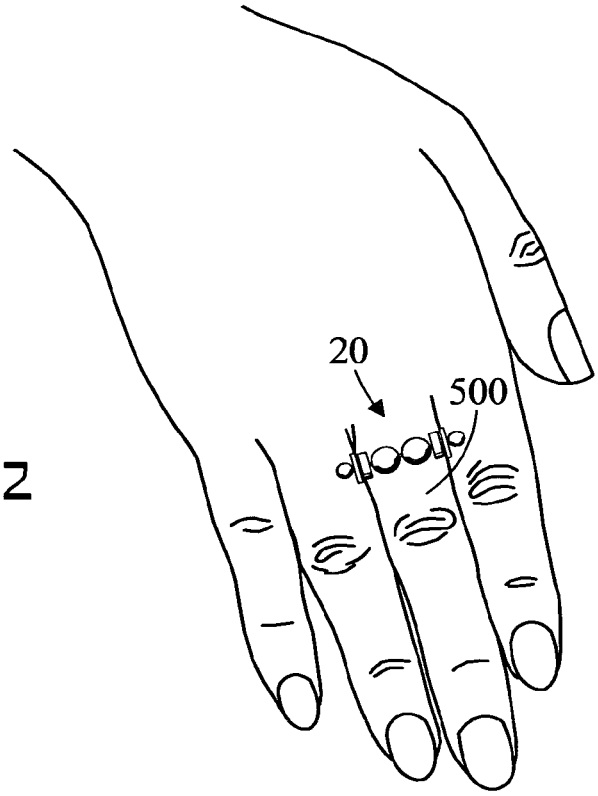
FIG. 2 is a top plan view of the ring on a finger.

Referring initially to FIG. 1, there is illustrated a perspective view of a ring for a finger in accordance with the present invention, generally designated as 20. FIG. 2 is a top plan view of ring 20 on a finger 500. It is noted that while the embodiments disclosed herein are directed to a ring 20 for a finger 500, the present invention can also find utility for other rings, including, but not limited to, toe rings. Thus, for purposes of this application the term "ring" should be read broadly to embrace these and other similar embodiments.

Ring 20 includes a shank 22 having a first side 24, an opposite second side 26, and a base 28 which connects sides 24 and 26 (refer also to FIGS. 3-7). First side 24 has a first slot 30, and second side 26 has a second slot 32. A cross member 34 is removably insertable into first 30 and second 32 slots and is slidably movable within slots 30 and 32 in direction 60 away from base 28 (refer also to FIGS. 19-21 and the associated discussions). It may be appreciated that slots 30 and 32 may be curved as shown, or may have a variety of other shapes (refer to FIGS. 10-12, and 22).

FIGS. 3-7 are top plan, front elevation, bottom plan, side elevation, and opposite side elevation views respectively of shank 22. Shank 22 is generally U-shaped (also refer to FIGS. 8 and 9). First side 24 has a first end 36, and second side 26 has an opposite second end 38. First slot 30 has a first mouth 40 and a first terminus (closed end) 42, and second slot 32 has a second mouth 44 and a second terminus 46. First terminus 42 is disposed between first mouth 40 and first end 36, and second terminus 46 is disposed between 44 second mouth and second end 38. In one embodiment of the invention, shank 22 is formed of sheet material such as 22-24 gauge pre-finished silver sheet. Although illustrated as having a uniform thickness T, the thickness of the sides 24 and 26 and base 28 can be non-uniform.

FIGS. 8 and 9 are front elevation views of other embodiments of shank 22. Shank 22 includes first side 24, second side 26, base 28, first slot 30, and second slot 32. It may be appreciated that other shank 22 shapes could also be utilized.

Figure 10:
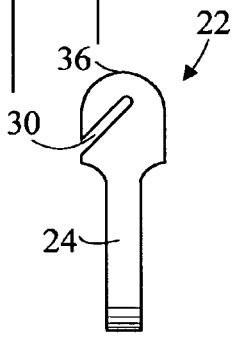
FIG. 10 is a side elevation view of another embodiment of the shank.
Figure 11:
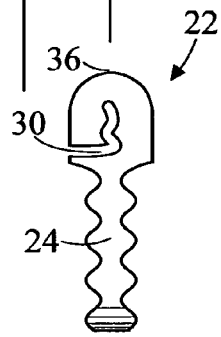
FIG. 11 is a side elevation view of another embodiment of the shank.
Figure 12:
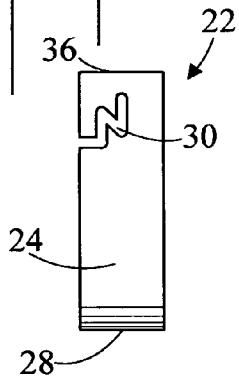
FIG. 12 is a side elevation view of another embodiment of the shank.

FIGS. 10-12 are side elevation views of other embodiments of shank 22. Slot 30 (and 32) may have the shown shapes, or virtually an unlimited number of other shapes, and may include curved portions, straight portions, or a combination thereof. It is noted that in FIG. 12 a portion of slot 30 doubles back toward base 28. Similarly, side 24 (and 26) may have the shown shapes or virtually an unlimited number of other shapes, and may include a rounded end 36, a square end 36, or other end designs as desired. Artistic appeal can dictate the shape of shank 22 and slots 30 and 32.

Figure 13:
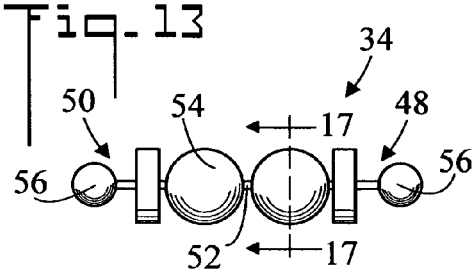
FIG. 13 is a top plan view of a cross member.
Figure 14:
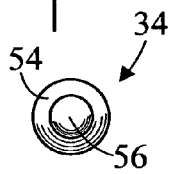
FIG. 14 is an end elevation view of the cross member.

FIGS. 13 and 14 are top plan and end elevation views respectively of cross member 34. Cross member 34 has a first end 48 and an opposite second end 50. First end 48 is insertable into first slot 30, and second end 50 is insertable into second slot 32 (also refer to FIG. 21 and the associated discussion). In the shown embodiment, cross member 34 includes a rod 52 which slidably engages first 30 and second 32 slots (also refer to FIG. 18).

At least one ornament 54 is connected to rod 52. A plurality of ornaments 54 are shown. Ornament 54 can be a desired shape, a desired size, and fashioned from a desired material. In an embodiment of the invention, ornament 54 is rotatable around rod 52. That is, ornament 54 has a hole which accepts rod 52 (refer to FIG. 17).

In an embodiment of the invention, rod 52 has two opposite end members 56. Also referring to FIGS. 19-21, when cross member 34 is inserted into first 30 and second 32 slots, rod 52 engages the slots and end members 56 reside outside of first 24 and second 26 sides of shank 22. As such, end members 56 serve to transversely retain cross member 34 in slots 30 and 32. End members 56 can be spherical as shown, cubic (refer to FIG. 16), or can have any another desired shape sufficient to retain cross member 34 in slots 30 and 32. It is noted that rod 52, may be formed from any suitable shaped material which can hold two end members 56 on each side, or even a wire material that is bent on each side and supports ornament(s) 54.

Figure 15:
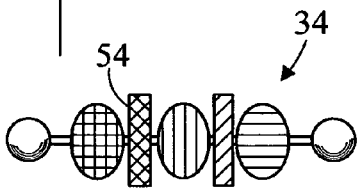
FIG. 15 is a top plan view of another embodiment of the cross member.
Figure 16:
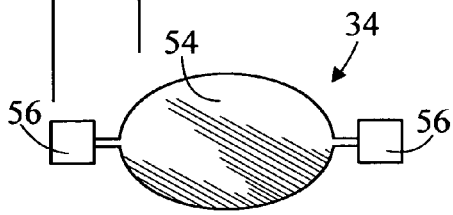
FIG. 16 is a top plan view of another embodiment of the cross member.

FIGS. 15 and 16 are top plan views of other embodiments of the cross member 34. In FIG. 15 cross member 34 includes a plurality (5 shown) of ornaments 54 made of different materials and/or colors (as denoted by different hash markings). In FIG. 16, ornament is fixedly not rotatably connected to rod 52, and end members 56 are cubic in shape.

Figure 17:
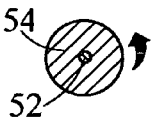
FIG. 17 is a cross sectional view along the line 17-17 of FIG. 13.

FIG. 17 is a cross sectional view along the line 17-17 of FIG. 13 showing ornament 54 having a hole which receives rod 52.

Figure 18:
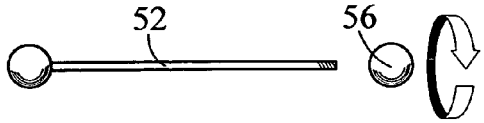
FIG. 18 is an exploded view of a rod and end members.

FIG. 18 is an exploded view of rod 52 and end members 56. One end member 56 is removable (such as by threads or other means) from rod 52 so that ornament(s) 54 may be removed and replaced. Alternatively, end members 56 may be fixedly connected to rod 52.

Figure 19:
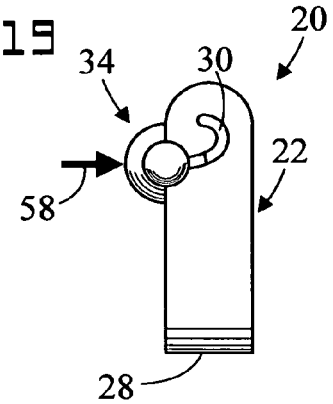
FIG. 19 is a side elevation view of the cross member starting to be inserted into slots in the shank.

FIG. 19 is a side elevation view of the cross member 34 starting to be inserted into slots 30 and 32 (refer to FIG. 6) in shank 22. Cross member 34 is placed adjacent to mouths 40 and 44 of slots 30 and 32 (refer to FIGS. 7 and 6) and urged into the slots in direction 58.

Figure 20:
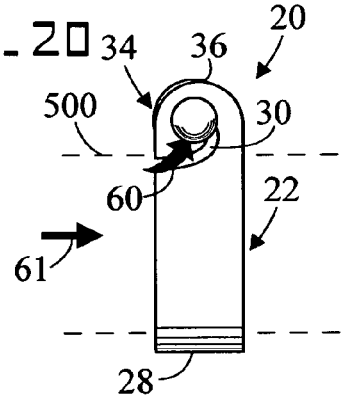
FIG. 20 is a side elevation view of the cross member fully inserted into the slots and a finger inserted into the ring.
Figure 21:
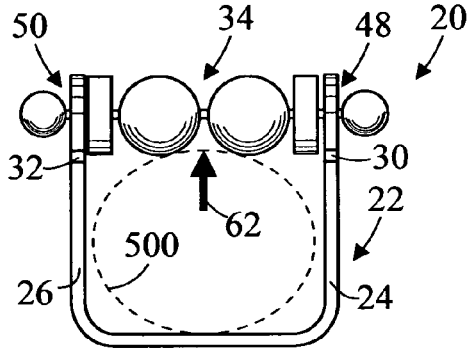
FIG. 21 is a front elevation view of the ring with a finger inserted.

FIG. 20 is a side elevation view of cross member 34 fully inserted into slots 30 and 32 and finger 500 inserted into ring 20, and FIG. 21 is a front elevation view of ring 20 with finger 500 inserted. Cross member 34 is first moved upwardly in direction 60 away from base 28 and toward ends 34 and 36 of sides 24 and 26 respectively of shank 22 (also refer to FIGS. 4, 6, and 7). As used herein, the term upwardly applies when shank 22 is in the shown base-down orientation. Then finger 500 is inserted into ring 20 in direction 61. If ornament 54 is rotatable around rod 52, then as finger 500 is inserted, ornament 54 will roll onto finger 500.

FIG. 21 is a front elevation view of ring 20 with finger 500 inserted between first 24 and second 26 sides of shank 22, and between cross member 34 and base 28. Cross member 34 has been fully inserted into slots 30 and 32 (as in FIG. 20), wherein ends 48 and 50 slidably engage the slots. Finger 500 urges cross member 34 upward in direction 62 thereby retaining it within the slots.

Figure 22:
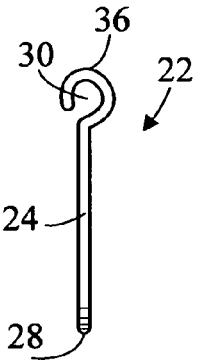
FIG. 22 is a side elevation view of another embodiment of the shank.

FIG. 22 is a side elevation view of another embodiment of shank 22. In this embodiment, shank 22 is made out of thick wire that is curved or bent at both ends to create slots 30 for receiving cross member 34 (refer to FIGS. 13 and 14).

In terms of use, a method for wearing a ring 20 on a finger 500 includes:

(a) providing ring components including:

a shank 22 having a first side 24, an opposite second side 26, a base 28 connecting first side 24 and second side 26, and first side 24 having a first slot 30 and second side 26 having a second slot 32; and, a cross member 34 removably insertable into first 30 and second 32 slots and slidably movable within slots 30 and 32 away from base 34;

shank 22 and cross member 34 being unconnected;

first slot 30 having an open end which comprises a first mouth 40 through which cross member 34 is removably insertable, and an opposite closed end which comprises a first terminus 42;

second slot 32 having an open end which comprises a second mouth 44 through which cross member 34 is removably insertable, and an opposite closed end which comprises a second terminus 46;

(b) inserting cross member 34 into first 30 and second 32 slots;

(c) slidably moving cross member 34 away from base 28; and, (d) inserting finger 500 between first 24 and second 26 sides and between base 28 and cross member 34, wherein finger 500 retains cross member 34 in first 30 and second 32 slots.

The method further including:

in step (a), cross member 34 having a first end 48 and an opposite second end 50, first end 48 insertable into first slot 30, and second end 50 insertable into second slot 32; and, in step (b), inserting first 48 and second 50 ends of cross member 34 into first 30 and second 32 slots respectively.

The method further including:

in step (a), cross member 34 including a rod 52 having two opposite end members 56; and, in step (b), placing rod 52 into first 30 and second 32 slots so that end members 56 reside outside first 24 and second 26 sides of shank 22.

The method further including:

in step (a), cross member 34 including a rod 52 to which is connected at least one rotatable ornament 54; and, during step (d), ornament 54 rolling onto the finger 500 of the wearer.

The ring of the present invention may be produced in various sizes by varying the dimensions of the shank, the size and shape of the slots, the length of the cross member, and the size of the ornament. Similarly, ring designs can be varied or customized by varying the materials of the shank and the cross member, varying the shape of the shank, placing ornamentation on the shank, varying the shape of the slots, varying the ornament(s), etc. The shank can also be made out of thick wire that is curved or bent at both ends to create the slots for the cross member.

Although silver and gold are the useful materials for ring components, any suitable material can be used, including, but not limited to, metals such as stainless steel, platinum, titanium, aluminum, nickel, copper, zinc, and combinations and alloys thereof, as well as stone, clay, ceramics, plastics and wood. As used herein, all mention of metals includes the associated pure metal and all alloys thereof. For example, "copper" includes pure elemental copper, as well as commercial grades of copper, brass, bronze, etc. The shank can be made of any suitable material, and in one embodiment is formed from pre-finished gold or silver sheet material, including, but not limited to, polished finishes, embossed finishes, rolled or stamped finished, chemically-induced patina finishes, brushed finishes, etched finishes, anodized finishes, painted or enameled finishes, and various combinations thereof, as is well known in the art of jewelry making.

It is another aspect of the present invention to provide a ring that can be fabricated using pre-finished sheet materials. The present invention also allows various components of the ring to be prefabricated and made available to jewelers, artists, and hobbyists. It is another aspect of the present invention to provide a ring that employs an independent rod that allows for a variety of ornamentation, as well as variety in sizes depending of the size of the rotatable ornaments.

In another aspect of the invention, the ring is assembled with a set of fabricated components that allow for mass production, custom fabrication as well as use in high end jewelry production.

Although disclosed herein with respect to a few particular embodiments, one of skill in the art would recognize that various other embodiments, such as forming the components of plastic to be assembled in a snap-together manner to make a toy ring, can be formed without departing from the scope of the invention.

The possible embodiments of the ring and method of wearing described herein are exemplary and numerous modifications, combinations, variations, and rearrangements can be readily envisioned to achieve an equivalent result, all of which are intended to be embraced within the scope of the appended claims. Further, nothing in the above-provided discussions of the ring and method of wearing should be construed as limiting the invention to a particular embodiment or combination of embodiments. The scope of the invention is best defined by the appended claims.

We claim:

1. A method for wearing a ring on a finger, comprising:

(a) providing ring components including:

a shank having a first side, an opposite second side, and a base connecting said first side and said second side, said first side having a first slot and said second side having a second slot; and, a cross member removably insertable into said first and second slots and slidably movable within said slots away from said base;

said shank and said cross member being unconnected;

said first slot having an open end which comprises a first mouth through which said cross member is removably insertable, and an opposite closed end which comprises a first terminus;

said second slot having an open end which comprises a second mouth through which said cross member is removably insertable, and an opposite closed end which comprises a second terminus;

(b) inserting said cross member into said first and second slots;

(c) slidably moving said cross member away from said base; and, (d) inserting the finger between said first and second sides and between said base and said cross member, wherein the finger retains said cross member in said first and second slots.

2. The method of claim 1, further including:

in step (a), said cross member having a first end and an opposite second end, said first end insertable into said first slot, and said second end insertable into said second slot; and, in step (b), inserting said first and second ends of said cross member into said first and second slots respectively.

3. The method of claim 1, further including:

in step (a), said cross member including a rod having two opposite end members; and, in step (b), placing said rod into said first and second slots so that said end members reside outside said first and second sides.

4. The method of claim 1, further including:

in step (a), said cross member including a rod to which is connected at least one rotatable ornament; and, during step (d), said ornament rolling onto the finger.

* * * * *